US006394054B1

(12) United States Patent
Rado et al.

(10) Patent No.: US 6,394,054 B1
(45) Date of Patent: May 28, 2002

(54) MECHANICAL COMPRESSION AND VACUUM RELEASE

(75) Inventors: Gordon E. Rado, Brookfield; Leonard E. Gescheidle, Rhinelander, both of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/760,953

(22) Filed: Jan. 15, 2001

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 2,999,491 A | | 9/1961 | Harkness | |
| 3,306,276 A | | 2/1967 | Harkness et al. | |
| 3,362,390 A | | 1/1968 | Etsy | |
| RE26,462 E | | 9/1968 | Harkness et al. | |
| 3,511,219 A | | 5/1970 | Esty | |
| 3,897,768 A | | 8/1975 | Thiel | |
| 3,901,199 A | | 8/1975 | Smith | |
| 3,981,289 A | | 9/1976 | Harkness | |
| 4,648,362 A | * | 3/1987 | Kastlunger | 123/182.1 |
| 4,672,930 A | | 6/1987 | Sumi | |
| 4,696,266 A | | 9/1987 | Harada | |
| 4,892,068 A | | 1/1990 | Coughlin | |
| 4,898,133 A | | 2/1990 | Bader | |
| 4,991,551 A | | 2/1991 | Terai et al. | 123/198 |
| 5,085,184 A | | 2/1992 | Yamada et al. | 123/182.1 |
| 5,197,422 A | | 3/1993 | Oleksy et al. | 123/182.1 |
| 5,317,999 A | * | 6/1994 | Kern et al. | 123/182.1 |
| 5,711,264 A | * | 1/1998 | Sezek et al. | 123/182.1 |
| 5,809,958 A | | 9/1998 | Gracyalny | 123/182.1 |
| 5,816,208 A | | 10/1998 | Kimura | 123/182.1 |
| 5,823,153 A | | 10/1998 | Santi et al. | 123/182.1 |
| 5,904,124 A | * | 5/1999 | Poehlman et al. | 123/182.1 |
| 5,957,097 A | | 9/1999 | Schanz | 123/90.17 |
| 5,992,367 A | | 11/1999 | Santi et al. | 123/182.1 |
| 6,055,952 A | | 5/2000 | Gau | 123/182.1 |
| 6,073,599 A | | 6/2000 | Kimura | 123/182.1 |
| 6,109,230 A | | 8/2000 | Watanabe et al. | 123/182.1 |

FOREIGN PATENT DOCUMENTS

| | | |
|---|---|---|
| GB | 1 243 551 | 8/1971 |

* cited by examiner

*Primary Examiner*—Paul J. Hirsch
(74) *Attorney, Agent, or Firm*—Baker & Daniels

(57) ABSTRACT

A four-stroke internal combustion engine includes a cylinder block having a cylinder therein and a piston reciprocally disposed within the cylinder. The piston is operably engaged with a crankshaft. At least one intake valve and one exhaust valve is reciprocally driven by a camshaft. A vacuum release mechanism includes an operating member rotationally supported by the camshaft and has an operator disposed thereon. A centrifugally actuated flyweight member is attached to the operating member, wherein rotation of the camshaft above engine cranking speeds causes the flyweight member to rotate the operating member. A vacuum release member is reciprocally supported by the camshaft and in engagement with the operator wherein rotational movement of the operating member causes radial translation of the vacuum release member through the operator. The operating member and flyweight member are urged to a first position at engine cranking speeds and rotated by the flyweight member through centrifugal force to a second position at engine running speeds. The vacuum release member is in lifting engagement with one of the valves at the first position during a portion of the power stroke and out of lifting engagement with the valve at the second position.

13 Claims, 6 Drawing Sheets

MECHANICAL COMPRESSION AND VACUUM RELEASE

BACKGROUND OF THE INVENTION

1. Field of the Invention

This invention generally relates to internal combustion engines, and more particularly to a compression release and vacuum release mechanism for four-stoke cycle engines.

2. Description of the Related Art

Compression release mechanisms for four-stroke cycle engines are well known in the art. Generally, means are provided to hold one of the valves in the combustion chamber of the cylinder head slightly open during the compression stroke while cranking the engine. This action partially relieves the force of compression in the cylinder during starting, so that starting torque requirements of the engine are greatly reduced. When the engine starts and reaches running speeds, the compression release mechanism is rendered inoperable so that the engine may achieve fall performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed. Examples of compression release mechanisms for four-stroke engines are numerous and share a common principle which includes activating a valve displacement feature at low crankshaft speeds, i.e., at startup, and deactivating the same at significantly higher crankshaft speeds i.e., run mode.

Presently, conventional four-stoke engines require a significant amount of torque to turn the engine over during the power stroke when combustion is not taking place. This is so because the piston is then moving downwardly against a pressure difference due to increasing suction resulting from the partial discharge of gas from the cylinder during the immediately preceding compression stroke. The increase of torque required corresponds to a substantial operator or starter force required to drive the piston downwardly against that pressure difference.

In response to the torque developed by suction, one prior art combustion engine suggests using a contoured cam lobe which acts to hold the valve open longer between the compression and power strokes. Starting torque was decreased by this mechanism, however compression and accordingly engine power would significantly decrease compared to conventional engines which employ the traditional "pear-shaped" cam lobes. Yet another prior art mechanism employed a light spring placed on the stem side of the exhaust valve to hold the valve open during start up. However, significant intake and exhaust manifold pressures would be required to close the exhaust valve and thus longer times and increased user effort is required to start the engine.

Another device which compensates for torque caused as a result of suction force during the power stroke is disclosed in provisional Patent Application No. 60/231,818, filed Sep. 11, 2000, and assigned to the assignee of the present application, the disclosure of which is expressly incorporated herein by reference. This device utilizes a saddle member pinned to an accessible area of the camshaft and includes a pair of auxiliary cams to sequentially relieve compression and vacuum by lifting the exhaust valve during appropriate portions of the compression and power stroke at engine cranking speeds. Although effective, this device is not readily adaptable to some existing engine designs.

Traditionally used engine crankcase designs require casting and machining modifications before this release may be implemented.

Accordingly, it is desired to provide a release mechanism that addresses the significant torque developed by both the compression and power strokes and one that is effective in operation and relatively simple in construction. It is further desired to provide a release mechanism which addresses this significant torque, and is retrofittable to a substantial number of existing engine crankcases without significant modification to the engine.

SUMMARY OF THE INVENTION

The present invention overcomes the disadvantages of prior internal combustion engines by providing a mechanical compression and vacuum release, of simple construct, including an operating member rotationally supported by a camshaft and attached to a centrifugally activated flyweight wherein movement of the centrifugal flyweight causes radial translation of a vacuum release member through an operator attached to the operating shaft and the vacuum release member is in lifting engagement with one of the intake or exhaust valves.

A four-stroke internal combustion engine is provided and includes a cylinder block having a cylinder therein and a piston reciprocally disposed within the cylinder. The piston is operably engaged with a crankshaft. At least one intake valve and exhaust valve are reciprocally driven by a camshaft. A vacuum release mechanism includes an operating member rotationally supported by the camshaft and has an operator disposed thereon. A centrifugally actuated flyweight member is attached to the operating member, wherein rotation of the camshaft above engine cranking speeds causes the flyweight member to rotate the operating member. A vacuum release member is reciprocally supported by the camshaft and in engagement with the operator wherein rotational movement of the operating member causes radial translation of the vacuum release member through the operator. The operating member and flyweight are urged to a first position at engine cranking speeds and rotated by the flyweight member through centrifugal force to a second position at engine running speeds. The vacuum release member is in lifting engagement with one of the valves at the first position during a portion of the power stroke of the piston and out of lifting engagement with the valve at the second position.

The present invention further provides a compression release mechanism. A compression release member is attached to the operator and urged to radially extend in response to rotation of the operating member. The compression release member and the vacuum release member successively attain lifting engagement with an intake or exhaust valve at the first position. The lifting engagement of the compression release member coincides with at least a portion of the compression stroke and the lifting engagement of said vacuum release member coincides with at least a portion of the power stroke. The compression and vacuum release members are out of lifting engagement with the valve at the second position.

An object of the present invention is to provide an engine having a mechanical vacuum release mechanism that overcomes substantial operator or starter force caused by suction forces acting on the piston during the power stroke at engine cranking speeds.

Another object of the present invention is to provide a compression and vacuum release mechanism easily retrofittable with existing engines crankcases wherein the release mechanism is disposed within the profile of the existing camshaft assembly. These and other objects, advantages and features are accomplished according to the devices, assemblies and methods of the present invention.

BRIEF DESCRIPTION OF THE DRAWINGS

The above mentioned and other features and objects of this invention will become more apparent and the invention itself will be better understood by reference to the following description of an embodiment of the invention taken in conjunction with the accompanying drawings, wherein.

Figure 1:
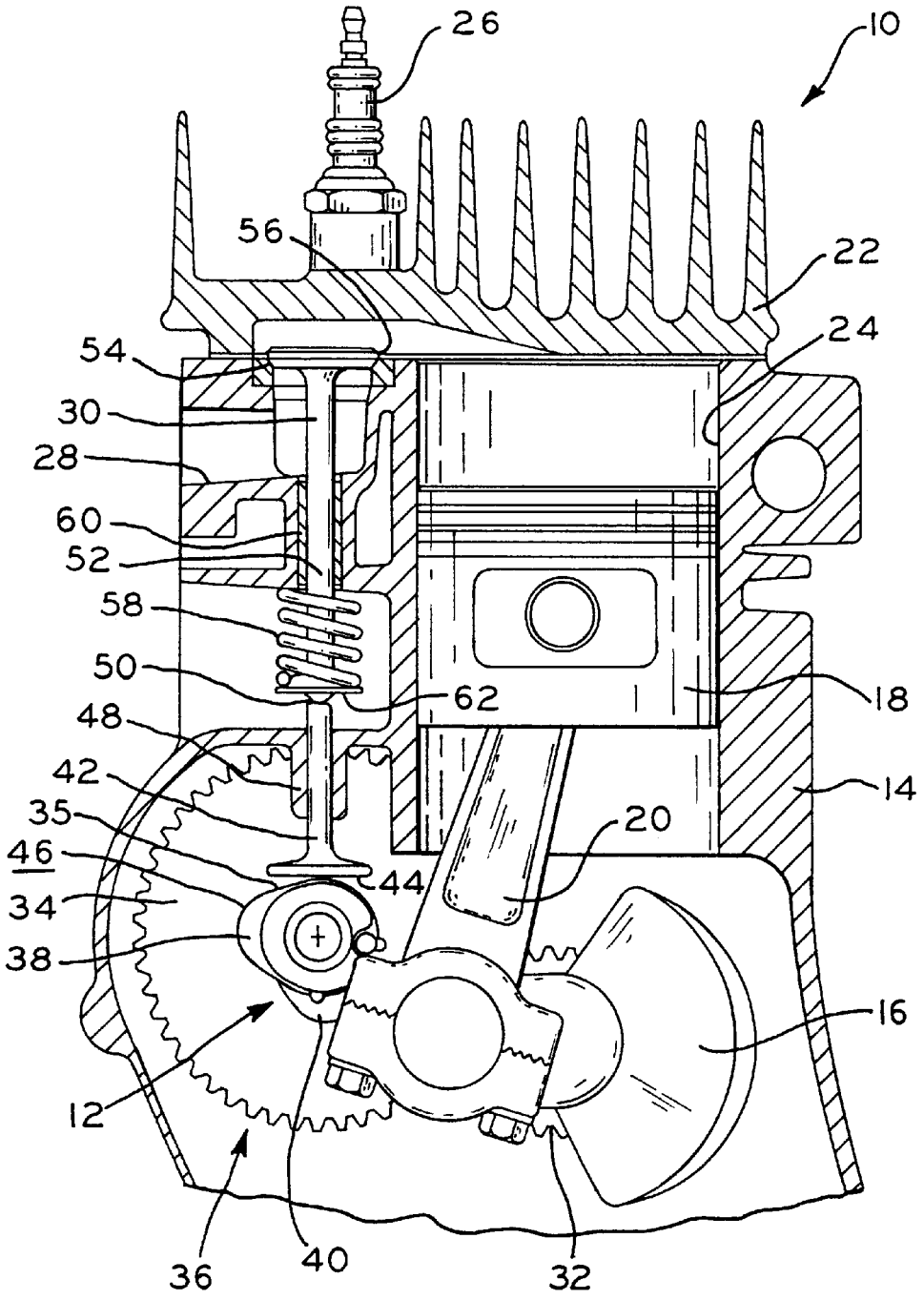
FIG. 1 is a sectional view of a single cylinder four-stroke internal combustion engine that incorporates a mechanical compression and vacuum release device in accordance with the principles of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring now to the drawings and particularly to FIG. 1, there is shown a single cylinder, four-stroke internal combustion engine 10 including a mechanical compression and vacuum release mechanism 12 according to the present invention. Engine 10 includes cylinder block 14, crankshaft 16 and piston 18, the piston being operatively connected to crankshaft 16 through connecting rod 20. Piston 18 coacts with cylinder block 14 and cylinder head 22 to define combustion chamber 24. Spark plug 26, secured in cylinder head 22, ignites the fuel/air mixture after it has been drawn into combustion chamber 24 through an intake valve (not shown) during the intake stroke and has been compressed during the compression stroke of piston 18. The spark is normally timed to ignite the fuel/air mixture just before piston 18 completes its ascent on the compression stroke. The fuel/air mixture is drawn into combustion chamber 24 from the carburetor of the engine through an intake passage controlled by the intake valve, and the products of combustion are expelled from the cylinder during the exhaust stroke through exhaust port 28 controlled by poppet-type exhaust valve 30. Although either exhaust or intake valve may be opened to vent compression and vacuum during start-up, it is recognized that preferably exhaust valve 30 cooperates with the compression and vacuum release mechanism 12 in a manner to be discussed hereinafter.

Other conventional parts of the valve operating mechanism include timing gear 32 mounted on crankshaft 16 for rotation therewith, and camshaft assembly 36 which includes lobed camshaft 35 and circular camshaft gear 34 rotatably driven by timing gear 32 to thereby rotate camshaft 35 at one-half crankshaft speed. Camshaft 35 comprises conventional pear-shaped exhaust and intake camshaft lobes 38 and 40, respectively, (FIGS. 1 and 2) which rotate with camshaft 35 to impart reciprocating motion to the intake and exhaust valves via intake or cam follower (not shown) and exhaust cam follower 42, respectively. Although FIG. 1 illustrates the compression and vacuum release mechanism in a side valve engine, this is but one engine type, and it is envisioned that the compression and vacuum release mechanism is amenable to other engine types, such as OHV and OHC engines, for example, and either vertical or horizontal shaft orientations. Additionally, multiple compression and vacuum releases according to the present invention may be employed on an engine having multiple cylinders, such as a twin cylinder engine, for example.

The exhaust valve train is shown in FIG. 1 and includes exhaust cam follower 42 having face 44 adapted to bear tangentially against, and remain in a continuous tracking relationship with, peripherally located bearing surface 46 of exhaust camshaft lobe 38. Cam follower 42 slides in guide boss 48 of block 14, and its upper end pushes against tip 50 of valve 30. In operation, cam follower 42 lifts stem 52 of exhaust valve 30 which lifts face 54 of valve 30 from valve seat 56. Valve spring 58 encircles stem 52 between valve guide 60 and spring retainer 62. Spring 58 biases valve 30 closed and also biases cam follower 42 into tracking contact with surface 46 of exhaust lobe 38.

Figure 2:
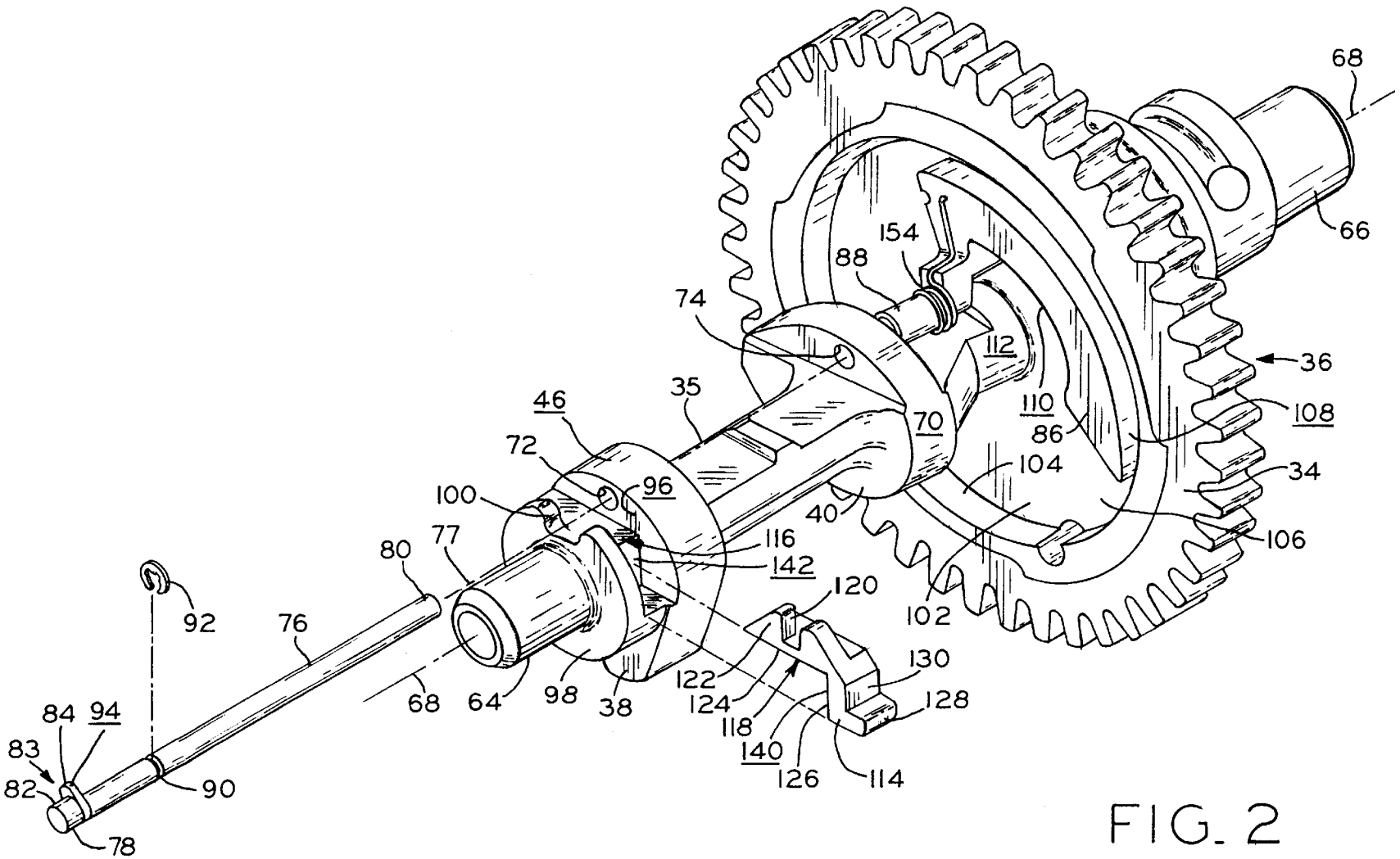
FIG. 2 is an exploded view of the camshaft and mechanical compression and vacuum release device of FIG. 1.
Figure 3:
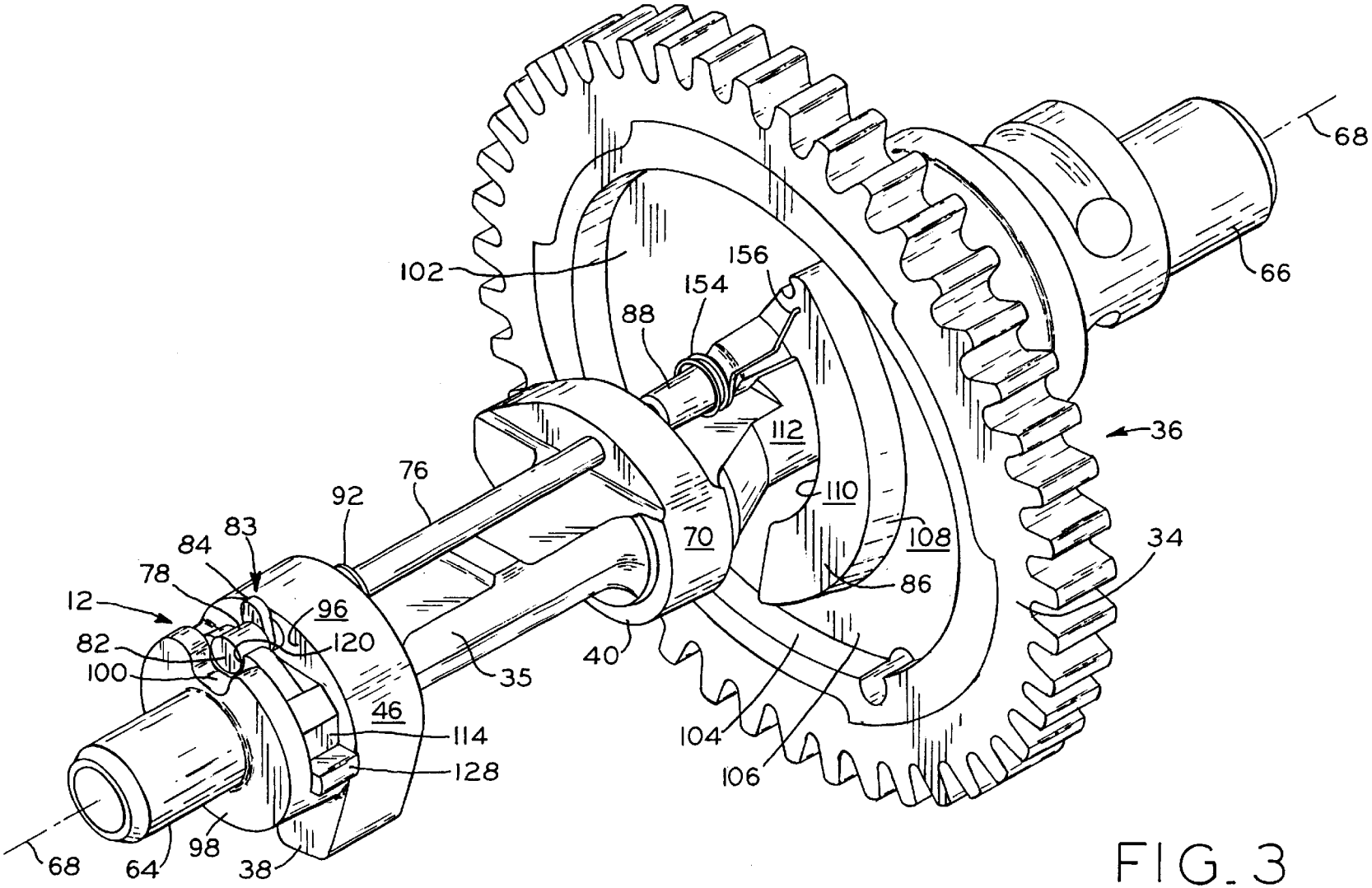
FIG. 3 is a perspective view of the camshaft and mechanical compression and vacuum release device of FIG. 1, illustrating the positioning of the mechanical compression and vacuum release device corresponding to engine startup.

Referring to FIGS. 2–3, camshaft assembly 36 includes annular camshaft gear 34 and elongate camshaft 35 extending axially through camshaft gear 34. Camshaft 35 includes first end 64 axially extended from a lateral surface of camshaft gear 34 and second end 66 extended in a direction opposite to that of first end 64. First and second ends 64, 66 of camshaft 35 are rotatably supported by engine block 14 through respective bearing assemblies, as is customary. Referring to FIG. 2, camshaft gear 34 and camshaft 35 are typically a single powder metal, forged, or injection molded component which has axis of rotation 68. First end 64 of camshaft 35 includes the pear-shaped exhaust and intake lobes 38, 40. Exhaust and intake lobes 38, 40 are provided with respective bearing surfaces 46, 70 which are in a continuously engaged relationship with respective followers (exhaust valve follower 42 shown in FIG. 1). Exhaust and intake lobes 38, 40 include axially extending through holes 72, 74, radially aligned relative to one another and have respective diameters slightly larger than the diameter of operating shaft 76, extending therethrough (FIG. 3).

Figure 7:
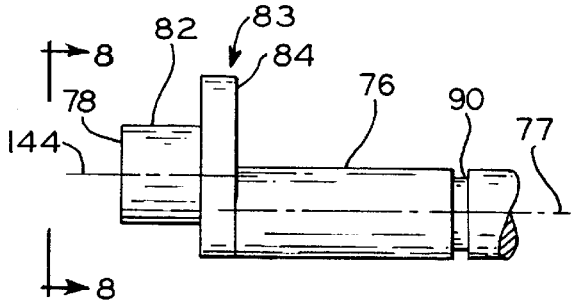
FIG. 7 is fragmentary view of the operating shaft illustrated in FIG. 4, depicting the compression release member and the operator.

Referring to FIG. 3, operating shaft 76 is rotatably supported by camshaft 35. Particularly, first end 78 of operating shaft 76 extends through hole 72 of exhaust lobe 38 and second end 80 extends through intake lobe 40. First end 78 of operating shaft 76 includes an operator in the form of a cylindrical eccentric 82 and radially extending compression relief projection 84. Second end 80 of operating shaft 76 is attached to sickle-shaped centrifugal flyweight 86. Centrifugal flyweight 86 includes cylindrical boss 88 which provides a base for engagement with second end 80 of operating shaft 76. Second end 80 of operating shaft 76 may be fixed with boss 88 of flyweight 86 through an interference fit or crimping engagement, for example. As best illustrated in FIGS. 2 and 7, operating shaft 76 includes groove 90 which is engaged by retaining ring 92 to prevent excessive movement of operating shaft 76 along axis of rotation 77 in a direction moving away from camshaft gear 34 of camshaft assembly 36. To prevent operating shaft 76 from excessive axial movement along axis 77 toward camshaft gear 34, lateral surface 94 (FIG. 2) of compression release projection 84 abuts transverse face 96 of exhaust cam lobe 38. End face 98 of camshaft 35 is provided with notch 100 to allow operating shaft 76 to be assembled with camshaft assembly 36.

Figure 4:
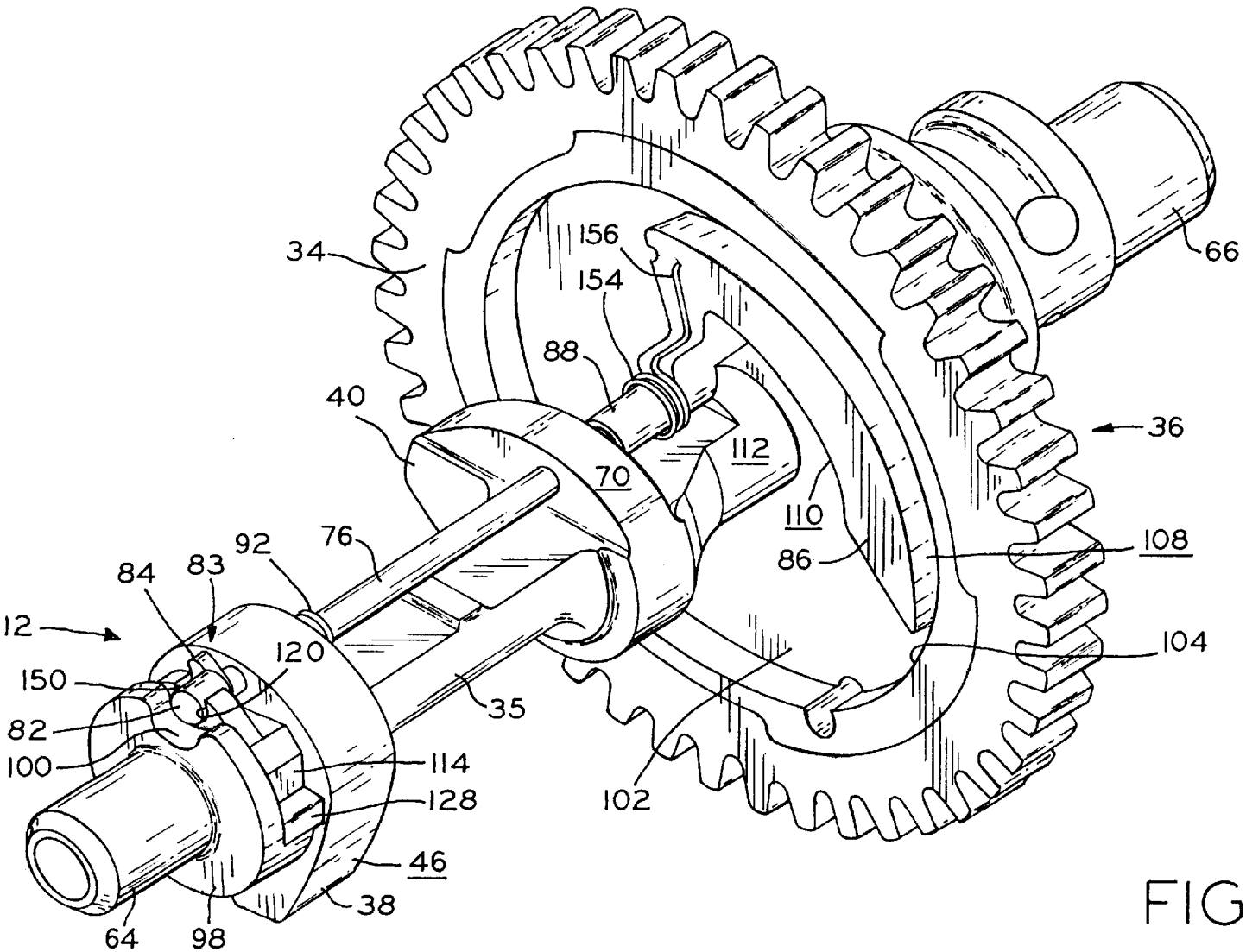
FIG. 4 is a perspective view of the camshaft and mechanical compression and vacuum release device of FIG. 1, illustrating the positioning of the mechanical compression and vacuum release device corresponding to an engine run position.

As best shown in FIG. 2, camshaft gear 34 of cam assembly 36 includes a dished recess 102 which encloses centrifugal flyweight 86. Recess 102 includes side wall 104 and end wall 106. Referring to FIG. 4, side wall 104 of recess 102 provides a rotational "stop" for operating shaft 76 by contact with outer surface 108 of centrifugal flyweight 86. When the camshaft assembly 36 attains a significant rotational velocity, coinciding with the engine in a run position, outer surface 108 of centrifugal flyweight 86 contacts side wall 104 of recess 102. At startup, as illustrated in FIG. 3, flyweight 86 includes an inner surface 110 which contacts outer surface 112 of camshaft 35 to provide a stop for the flyweight at rest. Therefore, it may be seen that mechanical compression and vacuum release 12 is substantially recessed into existing and surrounding structure provided by the camshaft assembly 36. Consequently, many different engine types may be adapted with the mechanical compression and vacuum release 12 without altering current and proven engine structures.

Figure 5A:
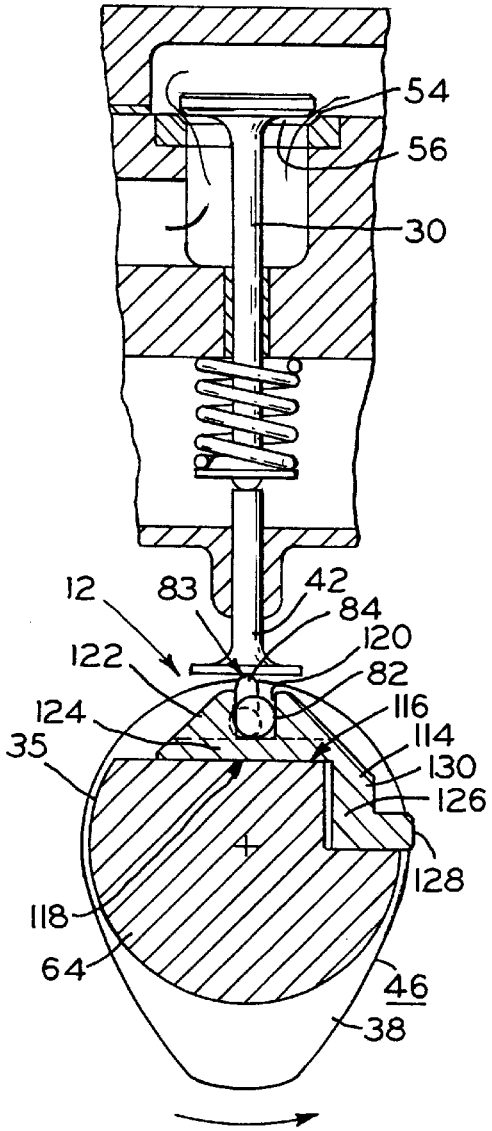
FIG. 5A is a fragmentary sectional view of the engine shown in FIG. 1, illustrating the compression and vacuum release assembly in the startup position, depicting a compression release member in an extended position to relieve pressure formed in the cylinder.
Figure 5B:
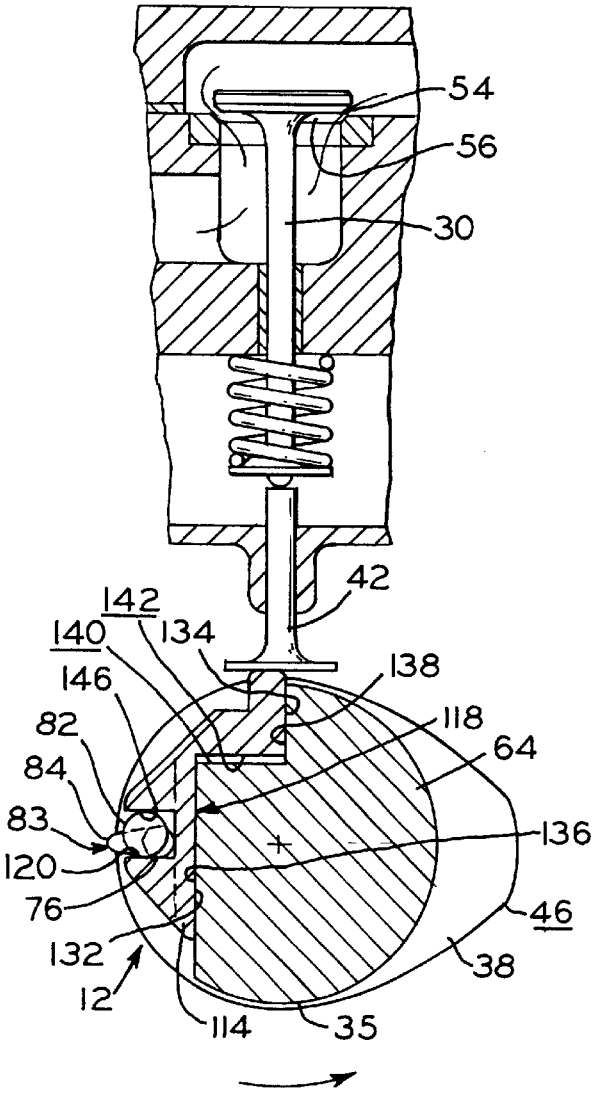
FIG. 5B is a fragmentary sectional view of the engine shown in FIG. 1, illustrating the compression and vacuum release assembly in the startup position, depicting a vacuum release member in an extended position to relieve vacuum formed in the cylinder.
Figure 6:
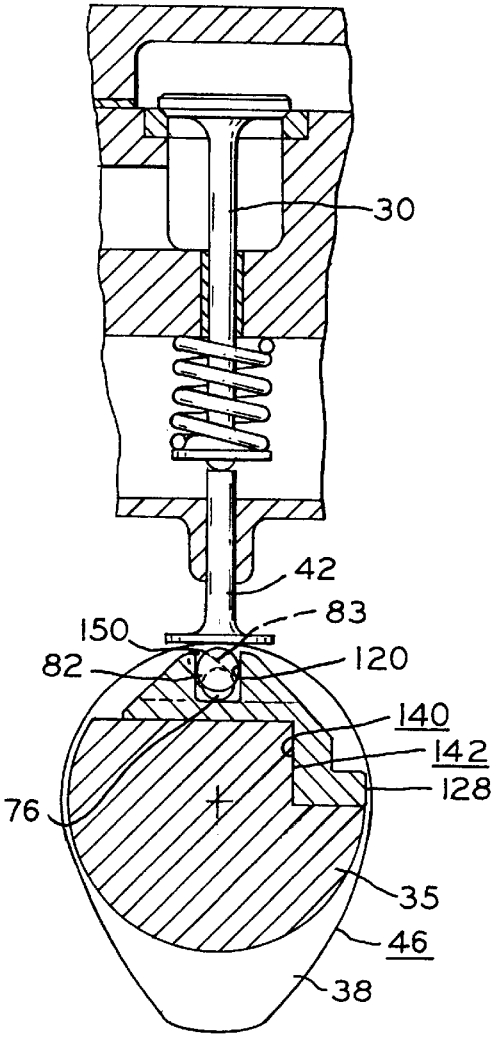
FIG. 6 is a fragmentary sectional view of the engine shown in FIG. 1, illustrating the compression and vacuum release assembly in the run position, depicting compression and vacuum release members recessed below the surface of the cam lobe.

Referring to FIGS. 2, 5A and 5B, outboard end 64 of camshaft 35 is fitted with vacuum release member or slider 114 to relieve suction forces acting on piston 18 (FIG. 1) as hereinafter described. First shaft end 64 includes a notched or stepped portion 116 formed in its periphery to facilitate engagement with complimentary stepped portion 118 of slider 114. Slider 114 is L-shaped and includes a slot 120 located within an outer portion 122 of a first segment 124 of L-shaped slider 114. Second segment 126 of L-shaped slider 114 includes vacuum release projection 128 outwardly extended from outer portion 130 of second segment 126. Referring to FIG. 5B, stepped portion 118 includes step surfaces 132 and 134 of slider 114 in sliding engagement with respective step surfaces 136, 138 of camshaft 35. Through step surfaces 132, 134 of slider 114, it may be seen that slider 114 is reciprocally supported by step surfaces 136, 138 of camshaft 35. Surface 140 of slider 114 is substantially perpendicular relative to step surfaces 132, 134 of slider 114 and engages complementary surface 142, provided by stepped portion 116 of camshaft 35, when the engine is in the run position (FIG. 6).

Figure 8:
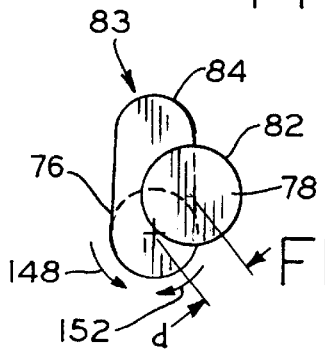
FIG. 8 is an end view of the operating shaft of FIG. 7 viewed along line 8—8 of FIG. 7.

As best shown in FIGS. 3 and 4, eccentric 82 extends into slot 120 in slider 114. Referring to FIG. 8, eccentric 82 is offset a distance "d" relative to axis of rotation 77 (FIG. 2) of operating shaft 76 such that centerline 144 (FIG. 7) of eccentric 82 "orbits" relative to axis of rotation 77 of operating shaft 76. Referring to FIG. 5B, operating shaft 76 has been positioned by torsional spring 154 (FIG. 2) such that eccentric 82 has urged slider 114 radially outward. In this position, eccentric 82 is in contact with front edge 146 of slot 120 causing movement of slider 114 such that surfaces 140, 142 of respective camshaft 35 and slider 114 are parted (FIGS. 5A, 5B). Conversely, and with particular reference to FIG. 6, counterclockwise rotation of operating shaft 76, illustrated by arrow 148 in FIG. 8, causes eccentric 82 to contact rear edge 150 (FIG. 4) of slot 120 urging slider 114 toward axis of rotation 68 (FIG. 2) of camshaft 35. Therefore, rotation of operating shaft 76 urged in a counterclockwise direction 148 by outwardly swinging flyweight 86 (FIG. 4) causes both compression and vacuum projections 84, 128 to recede beneath the bearing surface 46 of cam lobe 38. Accordingly, rotation of operating shaft 76 urged in a clockwise direction, illustrated by arrow 152 in FIG. 8, by inwardly swinging flyweight 86 causes both compression and vacuum projections 84, 128 to extend beyond bearing surface 46 of cam lobe 38 in preparation for engagement with cam follower 42 (FIGS. 5A, 5B).

As best illustrated in FIGS. 3 and 4, torsional spring 154 encircles the circumference of sleeve 88 of flyweight 86. Spring 154 includes first leg 156 anchored to flyweight 86 and second leg (not shown) in contact with camshaft 35. Spring 154 applies a bias to operating shaft 76, to assist in returning compression and vacuum release projections 84, 128, outwardly extended beyond surface 46 of lobe 38 as engine crankshaft speed, and associated camshaft speed, significantly slows corresponding to engine shutdown. At engine start-up, which corresponds with the mechanical compression and vacuum release 12 in positions depicted in FIGS. 3, 5A and 5B, flyweight 86 is in its retracted position and in contact with camshaft 35. Compression release member 83 comprises projection 84, located at first end 78 of operating shaft 76 and projects over bearing surface 46 of exhaust cam lobe 38 to interrupt the tracking relationship between follower 42 and cam lobe surface 46. Referring to FIG. 5A as cam lobe 38 rotates, compression release projection 84 is shown as having displaced cam follower 42 relative to bearing surface 46 of cam lobe 38. Consequently, face 54 of exhaust valve 30 is displaced relative to its seat 56 and the compressed air-fuel mixture in cylinder 24 (FIG. 1), during the compression stroke, is released.

Referring to FIG. 5B, subsequent to compression release projection 84 displacing valve 30 at engine startup, camshaft 35 continues to rotate and vacuum release projection 128 engages and displaces cam follower 42. Vacuum release projection 128 is outwardly extended in response to eccentric 82 urging slider 114 away from axis of rotation of camshaft 68 (FIG. 3). Similar to the compression release projection 84 displacing cam follower 42, vacuum release projection 128 displaces cam follower 42 and exhaust valve 30 is lifted from its seat 56 to alleviate the vacuum formed in the cylinder 24 during the power stroke.

Referring to FIG. 6, once camshaft 35 gains a significant rotational velocity, centrifugal flyweight 86 swings outwardly (FIG. 4). Consequently, operating shaft 76 rotates in a counterclockwise direction causing compression release projection 84 to pivot and recede beneath bearing surface 46 of lobe 38. Contemporaneously, eccentric 82 moves in an upwardly and counterclockwise motion causing slider 114 to move inwardly and vacuum release projection 128, affixed thereto, is accordingly receded beneath bearing surface 46 of cam lobe 38. As the engine slows, prompting a decrease in camshaft velocity, torsion spring 154 (FIG. 2) urges flyweight to swing inwardly and projections 84, 128 move toward, and eventually beneath, bearing surface 46 of cam lobe 38.

OPERATION

While device 12 is in its inoperative position (FIGS. 4 and 6), which is designated as the "run" position of the engine, the rotation of exhaust lobe 38 with camshaft 35 at "running speed" causes normal operation of valve 30, so that valve 30 opens and closes in timed and periodic relation with the travel of piston 18 according to conventional engine timing practice. Thus, exhaust lobe 38 is adapted to open valve 30 near the end of the power stroke and to hold the same open during ascent of the piston on the exhaust stroke until the piston has moved slightly past top dead center. As camshaft lobe 38 continues to rotate, spring 58 forces cam follower 42 downwardly and valve 30 is reseated. Valve 30 is held closed during the ensuing intake, compression and power strokes. Intake camshaft lobe 40 is likewise of conventional fixed configuration to control the intake valve (not shown) such that it completely closes shortly after the piston begins its compression stroke and remains closed throughout the subsequent power and exhaust strokes, and reopening to admit the fuel mixture on the intake stroke.

Since in a conventional engine the intake and exhaust valves are normally closed for the major portion of the power stroke, cranking of the engine is impeded because the piston must pull against a vacuum. However, by incorporating the compression and vacuum release mechanism of the present invention, compression and vacuum relief is automatically obtained at cranking speeds to greatly reduce cranking effort and thereby facilitate starting. Moreover, a conventional engine need not be physically altered to effect compression and vacuum release with the mechanism of the present invention incorporated therein. The compression and vacuum release mechanism is responsive to engine speed such that it is automatically rendered inoperative at engine running speeds so that there is no compression loss to decrease the efficiency of the engine when it is running under its own power.

Compression and vacuum release mechanism 12 affects the lift of exhaust valve 30 relative to rotation of crankshaft 16 as hereinafter described. Referring to FIG. 1, a four-stroke cycle internal combustion engine 10 is shown and provides four strokes of piston 18 to complete a cycle of operation of the engine, coinciding with 720° of rotation of crankshaft 16. On the intake stroke, piston 18 moves downwardly from the top of its travel (referred to as top dead center or TDC) to the bottom of its travel (referred to as bottom dead center or BDC). Intake valve (not shown) is opened and exhaust valve 30 is closed during the intake stroke. During the intake stroke, and at crankshaft running speed, a charge of air/fuel mixture is drawn into cylinder 24 above the head of piston 18 and through the intake valve (not shown). Following the intake stroke both the intake and exhaust valves close and the compression stroke is started. Toward the middle of the compression stroke, approximately 110° of crankshaft rotation before TDC, for example, mechanical compression release projection 84 lifts exhaust valve 30 to relieve cylinder pressure and then closes at about 60° before TDC. Following the compression stroke, piston 18 is urged toward BDC in the power stroke, which coincides with both intake and exhaust valves substantially closed. At approximately 60° of crankshaft rotation following TDC toward the end of the power stroke, vacuum release projection 128 lifts exhaust valve 30 off of its seat and suction forces due to vacuum formed in cylinder 24 is relieved.

For instance, in an exemplary embodiment of the compression and vacuum release 12, the intake valve may have a lift of 0.2 inches during the intake stroke and exhaust valve may be lifted 0.03 inches, and held open for 50° of camshaft rotation, by mechanical compression release projection 84 during the compression stroke. Specifically, the mechanical compression release opens the exhaust valve 30 at a crankshaft rotation of 110° prior to TDC and holds open exhaust valve 30 until crankshaft 16 is approximately 60° from TDC. The vacuum release activated by vacuum release projection 128 opens exhaust valve 30 a distance of 0.02 inches at a crankshaft rotation of 60° after TDC to vent suction caused by cylinder vacuum during the power stroke. Thus, the energy of the compressed air/fuel mixture is used to assist moving the piston during the power stroke. Projection 128 holds open exhaust valve 30 at 60° after TDC for a duration of 50° of crankshaft rotation.

The disclosed embodiment is not intended to be exhaustive or limit the invention to the precise forms disclosed in the detailed description. While the present invention has been described as having an exemplary design, the present invention can be further modified within the spirit and scope of this disclosure. Further, this application is intended to cover such departures from the present disclosure as come within known or customary practice in the art to which this invention pertains.

What is claimed is:

1. A four-stroke internal combustion engine, comprising:

a cylinder block including a cylinder therein and having a piston reciprocally disposed within said cylinder, said piston operably engaged with a crankshaft;

a camshaft;

at least one intake valve reciprocally driven by said camshaft;

at least one exhaust valve reciprocally driven by said camshaft; and a vacuum release mechanism, comprising:

an operating member rotationally supported by said camshaft and including an operator disposed thereon;

a centrifugally actuated flyweight member attached to said operating member, wherein rotation of said camshaft above engine cranking speeds causes said flyweight member to rotate said operating member from a first position to a second position; and a vacuum release member reciprocally supported by said camshaft and in engagement with said operator wherein rotational movement of said operating member causes radial translation of said vacuum release member through said operator, said operating member and flyweight urged to said first position at engine cranking speeds and rotated by said flyweight member through centrifugal force to said second position at engine running speeds;

said vacuum release member being in lifting engagement with one of said valves at said first position during at least a portion of the power stroke of said piston and out of lifting engagement with one of said valves at said second position.

2. The four-stroke internal combustion engine of claim 1, wherein said operator includes an eccentric portion offset relative to an axis of rotation of said operating member, and said vacuum release member is in translational tracking engagement with said eccentric portion.

3. The four-stroke internal combustion engine of claim 2, wherein said vacuum release member includes a slot and said eccentric portion extends into and is engaged with said slot.

4. The four-stroke internal combustion engine of claim 1, wherein said one of said valves is said exhaust valve.

5. The four-stroke internal combustion engine of claim 1, wherein said one of said valves lifted by said vacuum release member comprises an outboard valve.

6. The four-stroke internal combustion engine of claim 1, wherein said camshaft includes a notched portion engaged by a matching notched portion defined by said vacuum release member, and said vacuum release member is translationally guided through engagement of said notched portions.

7. The four-stroke internal combustion engine of claim 1, wherein said camshaft includes a transversely located camshaft gear and at least one cam lobe, said flyweight being substantially recessed within said camshaft gear and said operating member extending through said cam lobe, wherein said vacuum release mechanism at said second position is contained within a profile defined by outer margins of said camshaft.

8. The four-stroke internal combustion engine of claim 7, wherein said flyweight contacts said camshaft to provide a first rotational stop for said operating member corresponding to said first position and said flyweight contacts said camshaft gear to provide a second rotational stop for said operating member corresponding to said second position.

9. The four-stroke internal combustion engine of claim 1, further comprising a compression release member attached to said operating member, wherein rotation of said operating member urges said compression release member to be in lifting engagement with one of said valves at said first position during at least a portion of the compression stroke of said piston and out of lifting engagement with one of said valves at said second position.

10. The four-stroke internal combustion engine of claim 9, wherein said compression release member includes a projection and said vacuum release member includes a projection, said projections being in successive lifting engagement with said valve in said first position, said projections being separated by about 90°.

11. The four-stroke internal combustion engine of claim 1, wherein said flyweight is urged toward an axis of rotation of said camshaft by a spring, and wherein inward movement of said flyweight is at least partially influenced by said spring at engine speeds less than said engine running speeds.

12. A four-stroke internal combustion engine, comprising:

a cylinder block including a cylinder therein and having a piston reciprocally disposed within said cylinder, said piston operably engaged with a crankshaft;

a camshaft;

at least one intake valve reciprocally driven by said camshaft;

at least one exhaust valve reciprocally driven by said camshaft; and a compression and vacuum release mechanism, comprising:

an operating member rotationally supported by said camshaft and including an operator disposed thereon;

a centrifugally actuated flyweight member attached to said operating member, wherein rotation of said camshaft above engine cranking speeds causes said flyweight member to rotate said operating member, said operating member and flyweight member urged to a first position at engine cranking speeds and rotated by centrifugal force to a second position at engine running speeds;

a compression release member attached to said operating member and in lifting engagement with one of said valves at said first position coinciding with at least a portion of the compression stroke of said piston; and a vacuum release member reciprocally supported by said camshaft and in engagement with said operator wherein rotational movement of said operating member causes radial translation of said vacuum release member through said operator, said vacuum release member being in lifting engagement with one of said valves at said first position coinciding with at least a portion of the power stroke of said piston, said compression release member and said vacuum release member successively attaining lifting engagement with one of said valves at said first position, said compression and vacuum release members being out of lifting engagement with one of said valves at said second position.

13. The four-stroke internal combustion engine of claim 12, wherein said camshaft includes a transversely located camshaft gear and at least one cam lobe, said flyweight being substantially recessed within said camshaft gear and said operating member extending through said cam lobe, wherein said compression and vacuum release mechanism being contained within a profile defined by outer margins of said camshaft at said second position.

* * * * *